United States Patent [19]

Waldhauser et al.

[11] 4,339,841

[45] Jul. 20, 1982

[54] SQUEEGEE SUPPORT ASSEMBLY FOR AUTOMATIC FLOOR CLEANING MACHINES

[75] Inventors: Steven J. A. Waldhauser; Richard D. Masbruch, both of Lewiston, N.Y.

[73] Assignee: Wetrok, Inc., Niagara Falls, N.Y.

[21] Appl. No.: 206,276

[22] Filed: Nov. 12, 1980

[51] Int. Cl.[3] ..... A47L 7/00; A47L 11/30

[52] U.S. Cl. ..... 15/359; 15/98; 15/320

[58] Field of Search ..... 15/320, 353, 98, 359

[56] References Cited

U.S. PATENT DOCUMENTS

| | | | |
|---|---|---|---|
| 2,930,055 | 3/1960 | Fallen et al. . | |
| 3,065,490 | 11/1962 | Arones | 15/359 |
| 3,277,511 | 10/1966 | Little et al. . | |
| 3,290,716 | 12/1966 | Cain . | |
| 3,376,597 | 4/1968 | Boyd | 15/320 |
| 3,496,591 | 2/1970 | Sheler . | |
| 3,649,995 | 3/1972 | Ison . | |
| 3,722,025 | 3/1973 | Gledhill | 15/359 X |
| 3,824,645 | 7/1974 | Krier et al. . | |
| 3,833,961 | 10/1974 | Fortman et al. . | |
| 3,837,029 | 9/1974 | Kasper . | |
| 3,879,789 | 4/1975 | Kasper . | |
| 3,939,518 | 2/1976 | Whitney et al. . | |
| 3,942,214 | 3/1976 | Maasberg | 15/320 |
| 4,006,506 | 2/1977 | Burgoon . | |
| 4,037,289 | 7/1977 | Dojan . | |
| 4,173,056 | 11/1979 | Geyer . | |

*Primary Examiner*—Chris K. Moore

*Attorney, Agent, or Firm*—Christel, Bean & Linihan

[57] ABSTRACT

A squeegee support assembly for automatic floor cleaning machines of the type having a housing, drive wheels, spaced holders for floor cleaning members mounted for powered rotation about a vertically disposed axis and a substantially crescent-shaped vacuum housing and squeegee blade carrying assembly mounted to the housing for articulated movement about a vertical axis which is located at the midpoint between a diametral line passing through the axis of the holding members. The support assembly including an arm support member pivotally mounted to the housing for pivotal movement about a vertical axis, an upper arm having one end pivotally connected to the arm support member for rotation about a horizontal axis, a lower arm having one end pivotally connected to the arm support member below the upper arm end for rotation about a horizontal axis, a connecting structure at the other ends of the arms for pivotally connecting the same to the squeegee assembly and constraining the same to vertical movement with respect to the arm support member, the arms including adjusting means for adjusting the vertical pressure forces of the squeegee assembly against the floor when the blades thereof are in contact therewith and also including means for adjusting the attitude of such blades with respect to the floor surface, and a cable-pulley assembly for vertically lifting the squeegee assembly to it's inoperative position.

12 Claims, 4 Drawing Figures

Fig. 3.
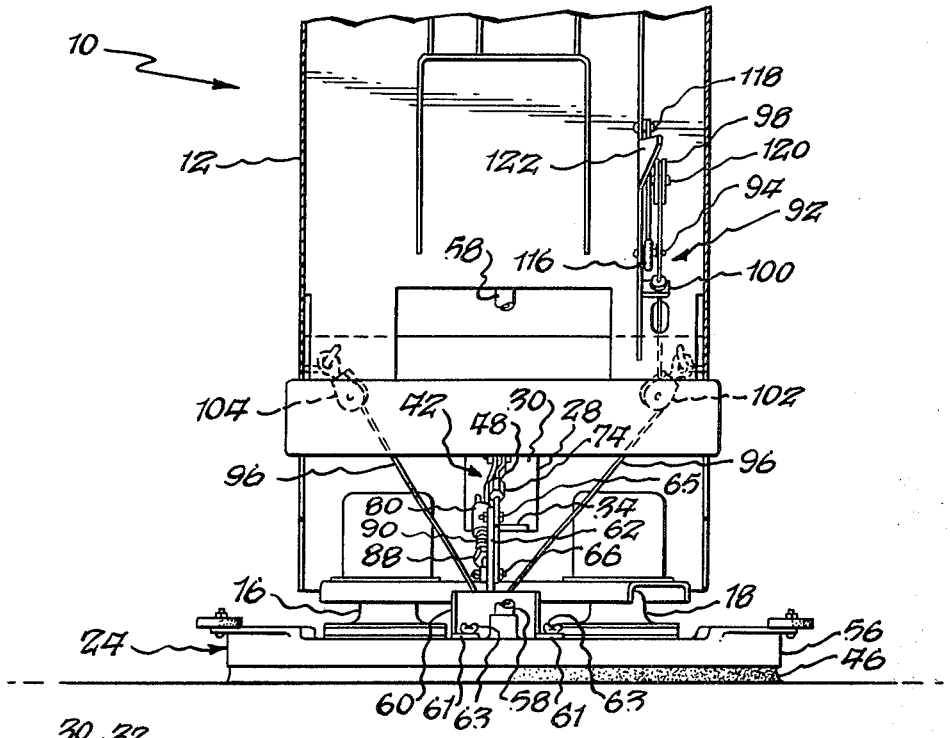
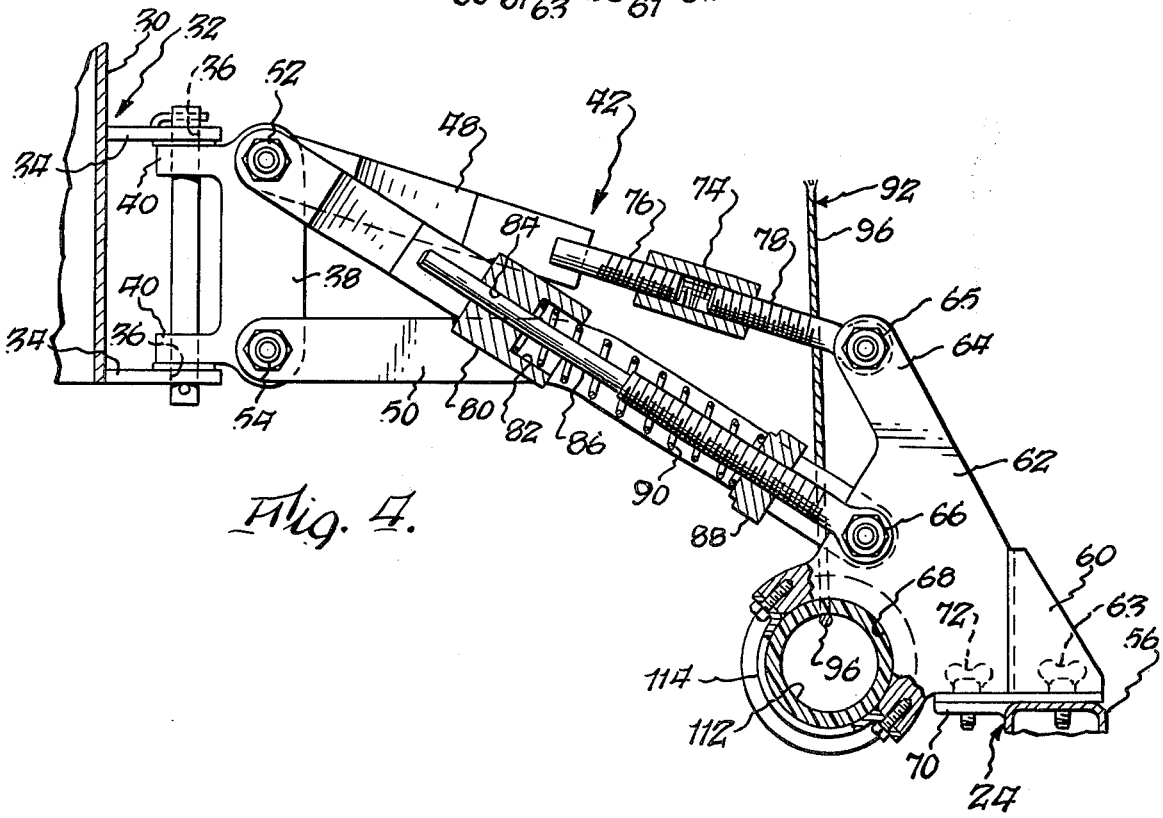
Fig. 4.

SQUEEGEE SUPPORT ASSEMBLY FOR AUTOMATIC FLOOR CLEANING MACHINES

BACKGROUND OF THE INVENTION

The present invention relates to automatic floor cleaning machines of the self-propulsion type having drive wheels, a pair of rotatably mounted floor-contacting members for washing, polishing and the like, and a dirty water vacuum pick-up in the form of a squeegee assembly located rearwardly of the floor contacting members; and, more particularly, to means for supporting, adjusting and lifting such assembly in relation to the housing or framework structure of the floor cleaning machine.

In the aforesaid floor cleaning machine it is important, for proper squeegee operation, that the floor-contacting squeegee blades of the squeegee assembly: maintain a generally perpendicular relationship to the floor; exert the proper pressure thereagainst regardless of the roughness or smoothness of the floor surface; and move quickly, easily and efficiently to an inoperative position spaced above the floor level when the squeegee action of the blades are not required, such as during blade replacement or polishing operations.

In copending U.S. application Ser. No. 186,420, filed Sept. 12, 1980 and assigned to the assignee of the present invention there is disclosed a squeegee assembly wherein the crescent-shaped vacuum housing of the squeegee-blade unit is disposed substantially along the arc of a circle the center of which coincides with the vertical axis passing through the midpoint of the extension of a diametral line between a pair of rotatably mounted circular floor treating units, such as brushes or buffers; and is universally supported at such center by means of a single rigid arm to thereby permit movement of the squeegee assembly about three perpendicular axes. As depicted in FIGS. 2 and 16 of the aforesaid application, this arm is pivotally affixed to the squeegee housing and cam means are provided to adjustably fix the pivot angle of the housing with respect to the support arm to thereby provide proper orientation of the squeegee blades with respect to the floor surface. In such prior application lifting of the squeegee assembly to its inoperative position above the floor is provided by means of an actuating handle and a separate multiple-linkage arrangement which acts upon the support arm causing the same to pivot upwardly about its universal mounting. An adjustable spring coacts with one of the multiple links to normally bias the squeegee blade unit into its operative, floor-engaging position.

In prior U.S. Pat. No. 3,065,490 of Nov. 27, 1962 to Arones, a straight squeegee vacuum housing is supported at each outer extremity thereof by a pair of parallel support arms; each of which being mounted for universal movement at opposite ends to permit lateral as well as vertical movement of the squeegee housing. Springs interconnect opposed ball-joints of each pair of arms to bias the squeegee housing in a downward, floor-contacting direction. To lift the squeegee housing to its inoperative position, means are provided in the form of a horizontally disposed cross-bar which is connected to a vertical strut at the rearward ends of each pair of arms. An actuating handle engages the cross-bar to thereby vertically lift the squeegee housing and its blades out of contact with the floor surface.

SUMMARY OF THE INVENTION

The present invention provides in an automatic floor cleaning machine of the type disclosed in the aforesaid U.S. patent application Ser. No. 186,420 a modified assembly for supporting the vacuum squeegee housing, for adjusting the blade pressure against the floor, for setting the blade orientation with respect to the floor and for lifting and securing the squeegee housing to its inoperative position above the floor.

The modified assembly of this invention provides a relatively simple, inexpensive, efficient, effective and compact structural arrangement for accomplishing the above objectives and, yet, utilizing a minimum number of parts which do not interfere with, hamper or otherwise impede the other, diverse functions of the machine, as specifically enumerated in the aforesaid patent application.

More specifically, the present invention provides a squeegee support assembly utilizing a compound arm unit secured at one end to the frame of the floor cleaning machine housing and at the other end to a point centrally of the crescent-shaped vacuum squeegee housing to permit lateral, articulated movement of the squeegee across the floor surface, vertical movement thereof in response to uneven or sloped floor surfaces along the path of the machine and to permit sufficient rocking movement thereof to accommodate uneven surfaces transverse of the path of the machine. The invention also incorporates, as a compact part of the compound arm unit, means for adjusting the pressure forces of the squeegee blades against the floor surface as well as means for initially positioning such blades at the proper orientation or attitude with respect to the floor surface and for maintaining such position during continued use.

Another significant feature of the present invention is the provision of an extremely simple cable-pulley arrangement for quickly lifting the squeegee assembly from its operative, floor-engaging position to its inoperative, vertically raised position.

Essentially, then, the present invention provides in an automatic floor cleaning machine having a housing; drive wheels for propelling the machine rotatably supported by the housing; a pair of spaced holders for floor cleaning members such as brushes or polishers, each such holders being mounted for powered rotation about a vertically disposed axis; and a substantially crescent-shaped vacuum housing and squeegee blade carrying assembly mounted to the housing for articulated movement about a vertical axis which is located at the midpoint between a diametral line passing through the axis of each of the holding members; the improvement of means for supporting, adjusting and lifting the vacuum housing, including; an arm support member pivotally mounted to the housing of the cleaning machine for pivotal movement about a vertical axis; a compound arm assembly comprising an upper arm having one end pivotally connected to the arm support member for rotation about a horizontal axis, a lower arm having one end pivotally connected to the arm support member below the upper arm end for rotation about a horizontal axis; means for pivotally connecting the other ends of the upper and lower arms to the squeegee housing at a position centrally of the extremities thereof whereby the arms and the squeegee housing are constrained to vertical movement with respect to the arm support member; adjusting means connected between opposite ends of each of the arms for adjusting the vertical pressure forces on the squeegee housing and the squeegee blades affixed thereto; and a cable assembly supported by the machine housing for vertically lifting the squeegee housing from its operative position whereat the squeegee blades thereof are in contacting relation to a floor surface to its inoperative position whereat such blades are vertically lifted from contact with the floor surface.

BRIEF DESCRIPTION OF THE DRAWINGS

For a fuller understanding of the present invention reference should now be made to the following detailed description thereof taken in conjunction with the accompanying drawings, wherein:

FIG. 3 is a rear elevational view of the cleaning machine taken substantially along line 3—3 of FIG. 1; and FIG. 4 is a partial sectional view of the supporting assembly taken substantially along line 4—4 of FIG. 2.

DESCRIPTION OF THE PREFERRED EMBODIMENT

Figure 1:
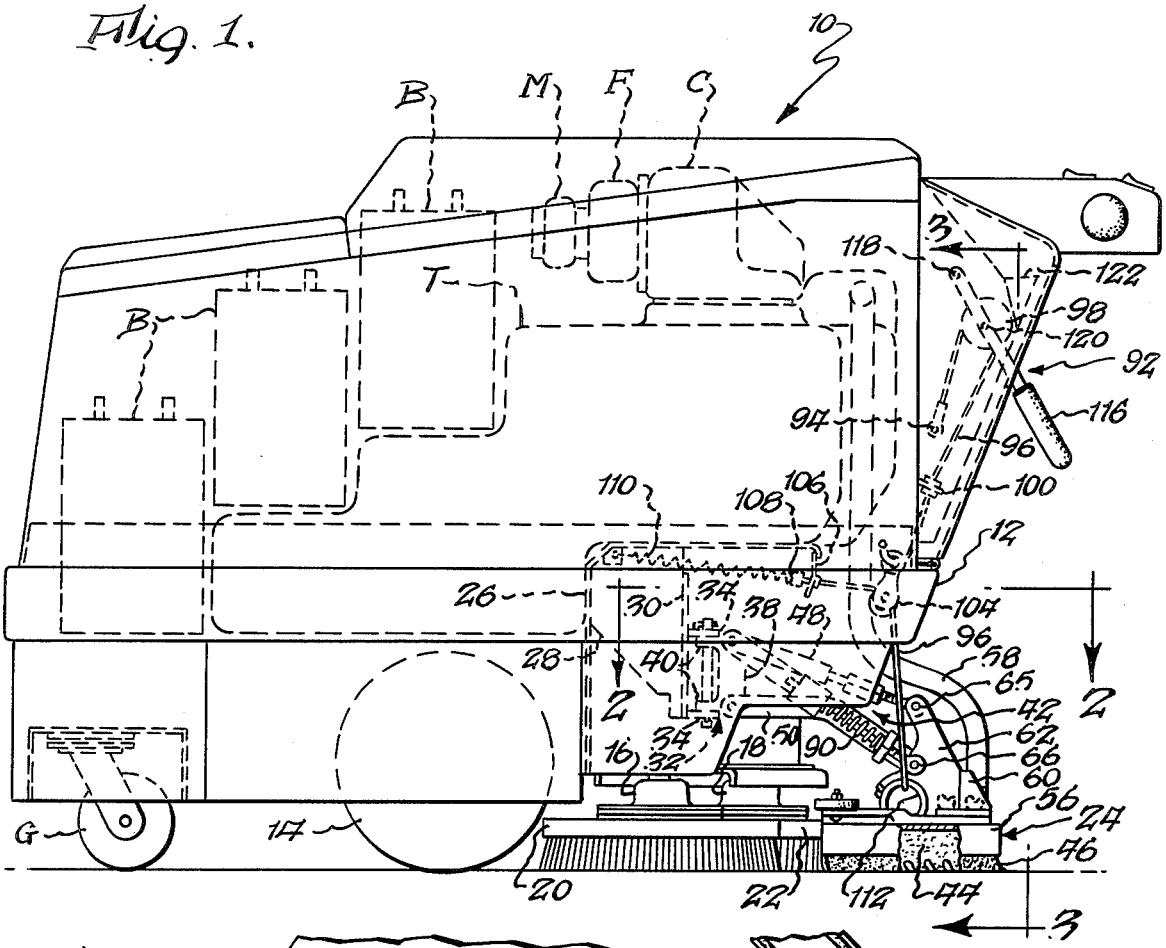
FIG. 1 is a side elevational view of the cleaning machine depicting the housing, the wheels, the brushes, the squeegee assembly and the supporting, adjusting the lifting means therefor in accordance with the teachings of the present invention.
Figure 2:
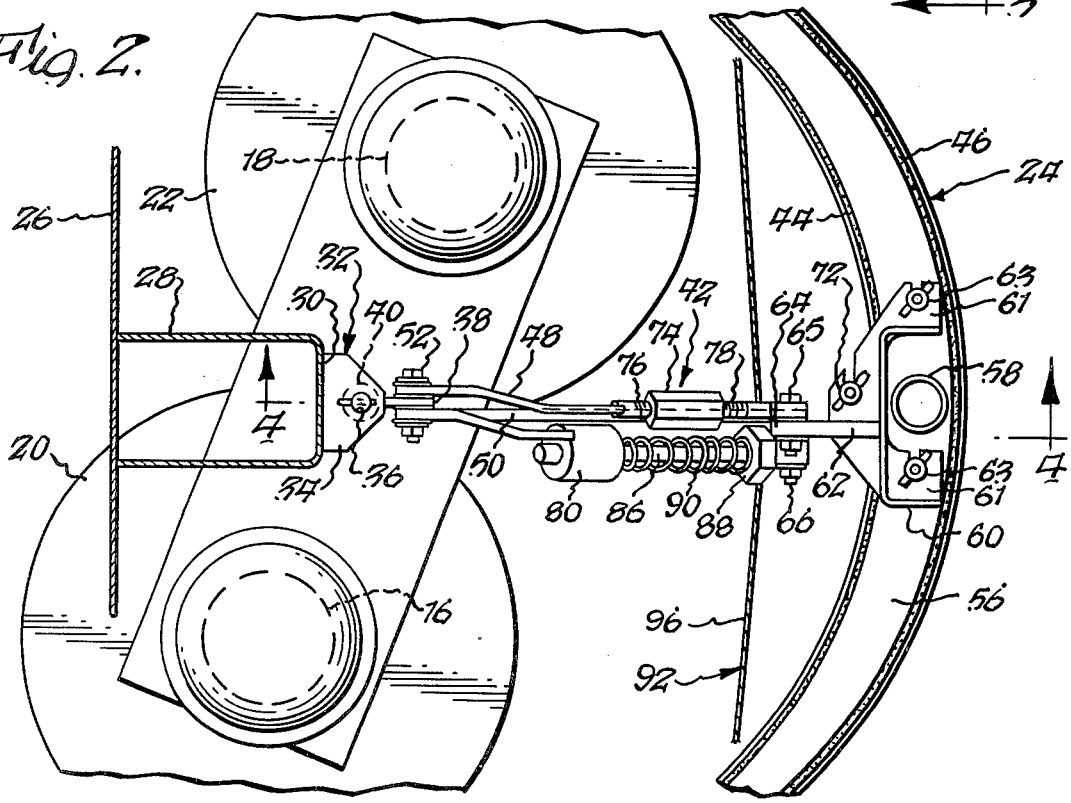
FIG. 2 is a fragmentary view taken substantially along line 2—2 of FIG. 1.

Referring to the drawings and, more particularly, to FIG. 1, the automatic floor cleaning machine is generally depicted at 10 and is shown as comprising; a housing or frame 12, a pair of laterally spaced wheels 14 (only one of which being illustrated) mounted to the housing for rotation about a horizontal axis to propel the housing and cleaning machine, a pair of spaced holders 16, 18 for floor treating devices such as brushes 20, 22 and a substantially crescent-shaped squeegee assembly 24 rearwardly spaced from the brushes and supported for articulated movement about a vertical axis which passes through the midpoint of a diametral line passing horizontally through the center of each of the brushes 20, 22 and their respective holders 16, 18. The foregoing structure, together with the dashed-line internal structure (such as batteries B, tank T, motor M, fan housing F, anti-fouling cover C and guide wheels or casters G) are all as disclosed and described in great detail in previously mentioned copending U.S. application Ser. No. 186,420 to which specific reference should be made for a more detailed discussion of these components, as well as others not specifically mentioned for a complete understanding of the structure and operation of the total machine. In as much as all the characterizing features of such machine form no specific part of the present invention, no further discussion thereof is deamed necessary except as the same adds to the environment and understanding of the characterizing features of the present invention.

Turning now to a discussion of the features of the present invention with references to all the FIGS., the machine housing 12 is provided with a horizontally disposed web or internal frame section 26 from which projects, in a rearward direction, a central U-shaped member 28. Fixedly secured to the bight 30 of member 28 is a support bracket 32 having a pair of vertically spaced arms 34; each containing vertically aligned openings 36. An arm support member 38 is pivotally mounted with respect to bracket 32 by means of a pin passing through aligned openings 36 and corresponding openings in lugs 40 of member 38.

A compound arm assembly, generally depicted at 42, is provided between bracket 38 and squeegee assembly 24 to support and constrain the same and leading and trailing floor contacting blades 44 and 46 carried thereby to vertical motion with respect to the bracket. To this end, assembly 42 comprises an upper arm 48 pivotally connected at one end thereof to bracket 38 for movement about a horizontal axis and a lower arm 50 pivotally connected at one end to bracket 38 at a point vertically disposed below the upper arm connection point for similar movement about a horizontal axis; these connections being depicted at 52 and 54, respectively. Means are provided to connect the other ends of arms 48 and 50 to the substantially crescent-shaped squeegee vacuum housing 56 at a point centrally disposed between the extremities thereof in straddling relation to the vacuum conduit 58 in communication with the interior of the housing. Such means may conveniently take the form of a bracket 60 having a pair of horizontally disposed flanges 61 which are secured by wing nuts 63 or the like to the horizontal upper surface of housing 56. Bracket 60 is provided with an upwardly and forwardly extending connecting member 62 having an upper tab 64 pivotally connecting at 65 the other end of upper arm 48, a lower opening for pivotally connecting to the other end of lower arm 50 as indicated at 66 and a substantially semi-cylindrical undersurface 68 for a purpose to become apparent hereinbelow. Connecting member 62 is secured to a flanged horizontal platform 70 extending from squeegee housing 56 by means of a wing nut 72 or the like. As should be apparent, the arrangement between upper arm 48, lower arm 50, connecting member 62, bracket 60, squeegee housing 56 and squeegee blades 44 and 46 is such that movement of the blades and the blade housing is constrained vertically with respect to arm bracket 38. Thus, once the blades are adjusted for proper perpendicular orientation with respect to the floor surface any movements thereof due to uneven surfaces or the like will be limited to vertical movements with respect to the bracket 38. In this manner proper blade orientation will be assured, even after continued and prolonged use. It should also be noted that the blades and the blade housing can move about a vertical axis as the cleaning machine makes turns or the like in that arms 48 and 50 are supported for lateral movement by means of vertically disposed pivot connection of bracket 38. Further, the lost motion or free-play afforded by this connection will also permit the blades and the blade housing some limited rocking motion to accommodate for floor unevenness laterally of the direction of travel of the floor cleaning machine. Torsional deflection of arms 48 and 50 also permits such limited rocking motion to accommodate the floor unevenness.

To adjust the orientation or attitude of the blades and the blade housing, arm 48 is made extensible and retractable by the provision of an internally threaded collar 74 which adjustably connects to intermediate, externally threaded upper arm sections 76 and 78. It can be seen that extension of upper arm 48 will cause connecting member 62 to pivot clockwise about point 66 to thereby cause corresponding movement of the blades in a clockwise direction. Generally, such adjustment would only be required for initial installation of the blades to ensure that the same are set for their proper tracking orientation with the floor surface; which orientation would normally be perpendicular thereto. Thus, the upper arm in addition to being part of a compound arm assembly to maintain proper blade tracking also serves as a convenient and compact means for providing an initial adjustment of the attitude of the blades with respect to the floor surface.

Compound arm assembly 42 is similarly provided with convenient and compact means for adjusting the pressure forces exerted by the blades against the floor surface. To this end, a compression spring assembly is provided between one end of upper arm 48 and the other end of lower arm 50. More specifically, an upper spring retaining member 80 is pivotally connected at one end to pivot point 52; with the other end thereof containing a cup-shaped recess 82 and a central throughbore 84. A spring rod 86 is pivotally connected at one end to pivot point 66 and is received at its other end in sliding relation to bore 84. A threaded adjusting nut 88 is secured in mating engagement with external threads on such other end of rod 86 for compressionally adjusting a compression spring 90 interposed between the nut 88 and the recess 82. The arrangement is such that clockwise rotation of nut 88 increases the bias of spring 90 to thereby increase the downward pressure of the blades against the floor surface, whereas counterclockwise rotation of the nut 88 relaxes the bias of the spring 90 to thereby decrease the pressure of the blades against the floor surface.

Completing the improvement of the present invention are means for lifting the blade housing from its operative position whereat the blades thereof are in contacting relation with the floor surface to its inoperative position whereat the blades thereof are lifted and secured out of engagement with the floor surface. As best seen in FIGS. 1, 3 and 4 such means, generally depicted at 92, comprises a cable suitable fixed at 94 to the frame of housing 12 adjacent one side thereof (the cable being indicated by the numeral 96) and extending upwardly therefrom about a pulley roller 98 thence downwardly through a fixed guide 100, about a fixed pulley 102, thence downwardly and inwardly underneath undersurface 68 of connecting member 64, thence upwardly and outwardly about a pulley 104 laterally spaced from pulley 102, fixed to the opposite side of housing 12, and thence forwardly through a fixed guide 106 and connecting at its opposite end to an abutment or stop member 108. A tension spring 110 is interposed in connecting relation to stop member 108 at one end thereof and to the frame of housing 12 at the other end thereof. Tension spring 110 functions to take up the slack in the cable 96 that would be caused as the blade housing 56 swings laterally from side to side in the normal operation of the floor cleaning machine, and when the blades are in their operative floor surface contacting position. However, when the cable is actuated to lift the blade housing by lifting contact with the undersurface of connecting member 62 the spring extension is limited by the abutment member contacting guide 106. To securely maintain cable 96 below undersurface 68 and to prevent the same from slipping away. Therefrom, there is provided an open-ended tubular ceramic guide member 112 which is clamped thereto by means of a C-shaped clamp member 114.

Actuating means are provided to raise the cable 96 to cause the same to lift and center the blade housing 56 and the blades 44 and 46 to their inoperative position above the floor surface. Such means includes an actuating handle 116 pivotally fixed to the housing frame at 118 and to an intermediate section to which pulley roller 98 is rotatably supported as depicted at 120. When handle 116 is raised upwardly roller 98 exerts an upward force on cable 96 against the tension of spring 110 which causes the cable to lift the undersurface of connecting member 62 through the ceramic tube 112 to thereby lift the squeegee housing and the squeegee blades to their raised inoperative position. As a result of the arrangement of cable 96 and pulley roller 98, handle 116 need only be raised a distance equal to approximately one half of the length of the portion of cable 96 being taken up to accomplish this lifting process. A skewed generally triangular member 122 fixed to the housing 12 adjacent handle 116 has an upper portion which crosses the plane of the handle as the same is raised to its upright position whereby relative flexure between the handle and such upper portion causes the handle to ride thereover and secure or lock itself in such raised position to maintain the squeegee assembly in its inoperative, raised position until the handle is brought out of contact with such upper portion permitting the squeegee assembly to be lowered by the cable to its operative, floor contacting position.

Although a preferred embodiment of the present invention has been disclosed and described, changes will obviously occur to those skilled in the art. It is therefore intended that the present invention is to be limited only by the scope of the appended claims.

What is claimed is:

1. In an automatic floor cleaning machine having a housing, drive wheels supported by the housing for rotation about a horizontal axis, a pair of spaced holders for floor treating devices supported by the housing for rotation about a vertical axis and a squeegee blade carrying assembly mounted to the housing for at least lateral movement about a vertical axis; the improvement of means for supporting said squeegee assembly, said means including:

an arm support member pivotally mounted to said housing for pivotal movement about a vertical axis;

a compound arm assembly including an upper arm having one end pivotally connected to said arm support member for rotation about a horizontal axis, a lower arm having one end pivotally connected to said arm support member below said upper arm for rotation about a horizontal axis;

means for pivotally connecting the other ends of said upper and lower arms to said squeegee blade carrying assembly centrally of the extremities thereof whereby said arms and said assembly are constrained to vertical movement with respect to said arm support member; and means supported by said housing for vertically lifting said assembly from its operative position whereat the blades thereof are in contacting relation to a floor surface to its inoperative position whereat such blades are vertically lifted.

2. The improvement according to claim 1, further comprising:

adjusting means connected between one opposite end of each of said upper and lower arms for adjusting the vertical pressure forces on said squeegee carrying assembly and on the blades carried thereby.

3. The improvement according to claim 2, wherein:

said adjusting means comprises a compression spring mounted at one end for pivotal movement with respect to said arm support member and at the other end for pivotal movement with respect to said means for pivotally connecting the other ends of said arms to said squeegee blade carrying assembly.

4. The improvement according to claim 2, further comprising:

means on one of said arms for adjusting the orientation of said squeegee assembly and the blades carried thereby with respect to a floor surface.

5. The improvement according to claim 4, wherein:

one of said arms comprises two spaced sections; and said last mentioned means is connected between said sections and is adjustable to vary the spacing therebetween.

6. The improvement according to claim 1, wherein:

said means for vertically lifting said assembly includes a cable fixed at one end to said housing, said cable passing through an undersurface of said means for pivotally connecting and resiliently secured at its other end to a laterally spaced point on said housing.

7. The improvement according to claim 6, wherein:

said means for vertically lifting said assembly further includes an actuating handle mounted for pivotal movement with respect to said housing, a roller mounted for rotation about a substantially horizontal axis and supported by said handle, said cable engaging said roller.

8. The improvement according to claim 7, further comprising:

a pair of laterally spaced pulleys fixed to said housing on opposite sides of said arm support member and in engagement with said cable;

a tension spring having one end connected to said housing and the other end connected to said other end of said cable;

a guide fixed to said housing for receiving said cable adjacent the other end thereof; and an abutment member connecting said tension spring and said cable between said guide and said tension spring, whereby as said squeegee assembly is vertically lifted the extension of said tension spring is limited by contact between said abutment member and said guide.

9. The improvement according to claim 1, wherein:

said squeegee assembly is substantially crescent-shaped and includes a vacuum housing for dirty water pick-up; and wherein the vertical axis about which said assembly laterally moves is located substantially at the midpoint of a diametral line passing through each of said holders.

10. The improvement according to claim 9, further comprising:

adjusting means connected between one opposite end of each of said upper and lower arms for adjusting the vertical pressure forces on said squeegee carrying assembly and on the blades carried thereby; and said adjusting means comprises a compression spring mounted at one end for pivotal movement with respect to said arm support member and at the other end for pivotal movement with respect to said means for pivotally connecting the other ends of said arms to said squeegee blade carrying assembly.

11. The improvement according to claim 10, further comprising:

means on one of said arms for adjusting the orientation of said squeegee assembly and the blades carried thereby with respect to a floor surface; and wherein one of said arms comprises two spaced sections and said last mentioned means is connected between said sections and is adjustable to vary the spacing therebetween.

12. The improvement according to claim 9, wherein:

said means for vertically lifting said assembly includes a cable fixed at one end to said housing, said cable passing through an undersurface of said means for pivotally connecting and resiliently secured at its other end to a laterally spaced point on said housing; and there is further provided a tension spring having one end connected to said housing and the other end connected to said other end of said cable;

a guide fixed to said housing for receiving said cable adjacent the other end thereof; and an abutment member connecting said tension spring and said cable between said guide and said tension spring, whereby as said squeegee assembly is vertically lifted the extension of said tension spring is limited by contact between said abutment member and said guide.

* * * * *